US007125597B2

(12) United States Patent
Kuchar

(10) Patent No.: US 7,125,597 B2
(45) Date of Patent: Oct. 24, 2006

(54) PENNANT TAPE

(76) Inventor: David M. Kuchar, 239 Main St., Metuchen, NJ (US) 08340

( * ) Notice: Subject to any disclaimer, the term of this patent is extended or adjusted under 35 U.S.C. 154(b) by 192 days.

(21) Appl. No.: 10/707,489

(22) Filed: Dec. 17, 2003

(65) Prior Publication Data

US 2005/0136215 A1 Jun. 23, 2005

(51) Int. Cl.
*B32B 3/24* (2006.01)

(52) U.S. Cl. ..... 428/136; 428/906; 116/173; 116/174; 116/DIG. 14

(58) Field of Classification Search ..... 428/136, 428/906; 116/173, 174, DIG. 14
See application file for complete search history.

(56) References Cited

U.S. PATENT DOCUMENTS

| | | | | | |
|---|---|---|---|---|---|
| 607,498 | A | | 7/1898 | Wheeler | |
| 1,116,942 | A | | 11/1914 | Smith | |
| 2,450,759 | A | * | 10/1948 | Leech | 428/132 |
| 2,633,440 | A | * | 3/1953 | Scholl | 428/40.1 |
| 2,688,303 | A | | 9/1954 | Leander | |
| 2,768,924 | A | * | 10/1956 | Wright | 428/72 |
| 2,805,485 | A | * | 9/1957 | Krummel | 33/563 |
| 3,219,010 | A | | 11/1965 | Hyatt | |
| 3,282,057 | A | | 11/1966 | Prosser | |
| 4,099,765 | A | * | 7/1978 | Bright | 296/93 |
| 4,105,190 | A | | 8/1978 | Curtis | |
| 4,105,724 | A | * | 8/1978 | Talbot | 261/112.1 |
| 4,177,750 | A | | 12/1979 | Scarlet | |
| 4,474,132 | A | | 10/1984 | Fritsch | |
| 4,623,282 | A | | 11/1986 | Allen | |
| 4,699,838 | A | | 10/1987 | Gilbert | |
| 4,813,369 | A | | 3/1989 | Moreland | |
| 5,039,048 | A | | 8/1991 | Paxton | |
| 5,244,715 | A | * | 9/1993 | Kuchar | 428/195.1 |
| 5,423,281 | A | | 6/1995 | Crookham et al. | |
| 5,564,207 | A | * | 10/1996 | Wagner | 40/124.14 |
| 5,967,788 | A | * | 10/1999 | Udoh | 434/211 |
| 6,247,262 | B1 | | 6/2001 | Wallace | |
| 2003/0211316 | A1 | | 11/2003 | Nagel et al. | |

* cited by examiner

*Primary Examiner*—William P. Watkins, III
(74) *Attorney, Agent, or Firm*—Stanley H. Kremen; Patents Group, LLC

(57) ABSTRACT

A tape barrier, warning, or display composed of flexible material having generally parallel edges and substantially greater length than width with cuts made into the tape at intervals along the tape defining pennants and connecting bands. The tape may be any color or even transparent, and messages or images may be applied thereon. The tape is deployed by placing longitudinal tension or pulling on a segment. Upon deployment, the tape lengthens and the pennants drop. The appearance is of a series of spaced apart hanging pennants held together by connecting tape material.

17 Claims, 4 Drawing Sheets

PENNANT TAPE

CROSS REFERENCE TO RELATED APPLICATIONS

The present invention is related to my U.S. Pat. No. 5,244,715 granted to me on Sep. 14, 1993. Said patent is incorporated in its entirety herein by reference thereto.

BACKGROUND OF INVENTION

For many years, ribbons or strips have been used to mark off work or hazardous areas. In many instances the ribbons or strips have been made of a flexible plastic tape deployed between and attached to supports. Once deployed, these strips block passage of pedestrians or vehicles from hazardous areas. Often, the tape material is brightly colored. It may also have a warning printed or applied on it in a contrasting color. One advantage of using tape material of this type over some of the other materials is that tape is often distributed and stored in rolls. A user only unrolls that amount of tape necessary for deployment, and re-stores the remaining tape.

My invention, Flag Strip (U.S. Pat. No. 5,244,715), is an example of such a tape. The flexible plastic tape has parallel edges, and is substantially longer than it is wide. There are cuts made into the tape at selected intervals along the tape that define pennants which extend generally along the length of the tape. When it is deployed and longitudinal tension is applied, the pennants partially separate from one edge of the tape. These pennants can make the tape more noticeable and may help to emphasize the cautionary nature of the tape.

Also for many years, advertising displays have been available with hanging pennants or banners strung together, usually by some sort of fiber or metal rope material. An example of this may be seen in a patent by R.J. Leander (U.S. Pat. No. 2,688,303—Patented Sep. 7, 1954). Another example of the use of a rope with hanging pennants for warning purposes is the water ski tow rope of B. G. Moreland (U.S. Pat. No. 4,813,369—Patented Mar. 21, 1989). Naval pennants are often strung together to communicate information. Other devices are available that display hanging pennants, but the connecting support structure is rigid. In any event, mechanisms of this type cannot be stored as compactly as flexible tape that is rolled. My flag strip invention allows for compact storage of rolls of tape that deploy into a series of hanging pennants that remain connected to each other by the flexible tape material. An advantage of using the flag strip is that a message can be printed or applied in contrasting colors on the material that connects the pennants to each other as well as on the pennants themselves. A great advantage of using the flag strip over the other conventional pennant banner hanging devices is its relatively low cost. However, flag strip is limited to long and narrow pennants that are different from conventional pennant displays having somewhat wider pennants.

T. Scarlet (U.S. Pat. No. 4,177,750—Patented Nov. 12, 1978) teaches that individual pennants may be cut from a continuous flexible tape most economically by inverting alternate pennants. Using this method, a flexible tape comprised of triangular pennants is produced with alternating triangles inverted. Arranging the triangles in this way minimizes the wasted plastic material. The length of each pennant can be almost equal to the width of the tape. However, there is no suggestion in this patent for the pennants to be deployed and also to remain connected by tape material as is the case for my flag strip. Scarlet separates the pennants from the tape and from each other, and prepares them for conventional deployment as is shown in Leander or Moreland.

There is a need for an inexpensive multi-banner device that can be stored compactly in rolls, and that permits a wider variety of banner shapes than does flag strip. Such a device should permit a portion of the rolled material to be deployed as desired, and the remaining material to be re-stored until needed.

The present invention is a flexible tape that deploys to present a series of pennants or banners, larger than the strips of U.S. Pat. No. 5,294,715, connected to each other by flexible connectors. The tape is cut in such a way as to define the pennants and connectors. When deployed, the pennants separate from the connectors to form hanging pennants, their appearance being similar to that of the conventional devices.

Many tape or ribbon materials have significant tensile strength. Some of these materials have the additional property that they may be stretched without significantly diminished tensile strength. Upon deployment, tape made from these materials can be stretched without tearing, and the distance between the pennants would be elongated without unacceptable pennant distortion. This property enhances the compact storage characteristics.

DETAILED DESCRIPTION

The invention described herein is a flexible tape having two generally parallel edges and substantially longer than it is wide. Cuts are made into the tape at selected intervals along the tape. These cuts optionally may or may not penetrate the entire thickness of the tape. They may also optionally be perforated (e.g., as a series of holes or slits). The cuts are made in such a way as to define a plurality of pennants alternating with a plurality of connecting bands. Each band is connected at one end to one adjacent pennant and at the other end to the other adjacent pennant. In addition, at least a portion of one edge of each connecting band is coincident with at least a portion of an edge of an adjacent pennant. Furthermore, at least a portion of that same edge or a portion of the other edge of the same connecting band is coincident with at least a portion of an edge of the other adjacent pennant. Normally, the entire edge of a connecting band is coincident with the entire edge of a pennant, but this is not necessary.

When longitudinal tension is applied to the tape, the edges of the connecting bands separate from the edges of the adjacent pennants. This substantially increases the length of the tape, thus forming a series of spaced apart hanging pennants held together by the connecting bands.

Figure 1:
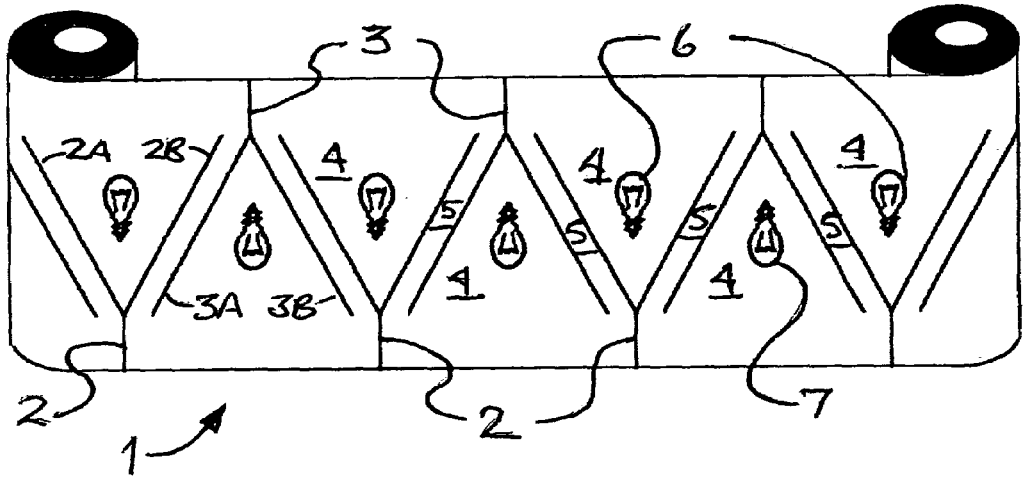
FIG. 1 shows a section of tape having Y-shaped cuts that produce hanging triangular pennants when the tape is deployed.

Referring to FIG. 1, a section of tape, 1, is shown with Y-shaped cuts. Each 'Y' has a stem and two branches. A stem is formed by making a generally transverse cut from the edge of the tape to a point relatively close to that edge. The alternating Y-shapes are inverted. The cuts for stems 2 and stems 3 are made from opposite edges of the tape. The two branches A and B, of each 'Y' extend at some angle to each other from the end of the stem, i.e., the junction, substantially toward the opposite edge of the tape, terminating near that opposite edge. Preferably, a straight line connecting the end points of the branches and the junctions of the adjacent Y-shaped cuts lie upon a single line parallel to the tape edges. These cuts define pennants 4 and connecting bands 5. For illustrative purposes, a series of light bulbs is printed in the pennant areas on one surface of the tape. Right-side-up light bulbs 6 are printed on the faces of every other pennant. Upside-down light bulbs 7 are printed on the faces of the alternate pennants. Each light bulb is printed with its base towards the point of its pennant.

Figure 2:
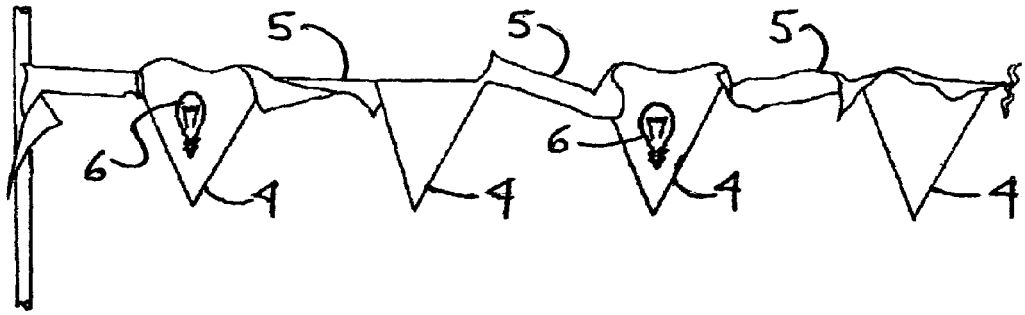
FIG. 2 shows the connected hanging triangular pennants after deployment of the tape shown in FIG. 1.

Upon deployment, the tape shown in FIG. 1 separates to produce hanging triangular pennants separated by connecting bands. Initially, alternate pennants were pointing up and down. When deployed, the downward pointing pennants continue to point down. Provided that the tape material is sufficiently flexible, and the length of the pennants is sufficiently large, the upward pointing pennants will fall to point down thereby twisting the connecting bands. This is shown in FIG. 2. Pennants 4 are separated by bands 5. Note that only right-side-up light bulbs 6 are visible. Such a light bulb appears on the face of every other pennant. The alternate pennants appear blank. This due to the fact that the pennant surfaces that were on the same side of tape prior to deployment now alternately face in opposite directions. Therefore if one were to view the opposite side of the deployed display, one would see a right-side-up light bulb on the face of every other pennant also.

If the material is less flexible (i.e., relatively stiff), or the length of the pennants is sufficiently small, the upward pointing pennants would not fall, and the light bulbs would appear on only one face of the deployed tape. Here the light bulbs would alternate being right-side-up and upside-down.

Figure 3:
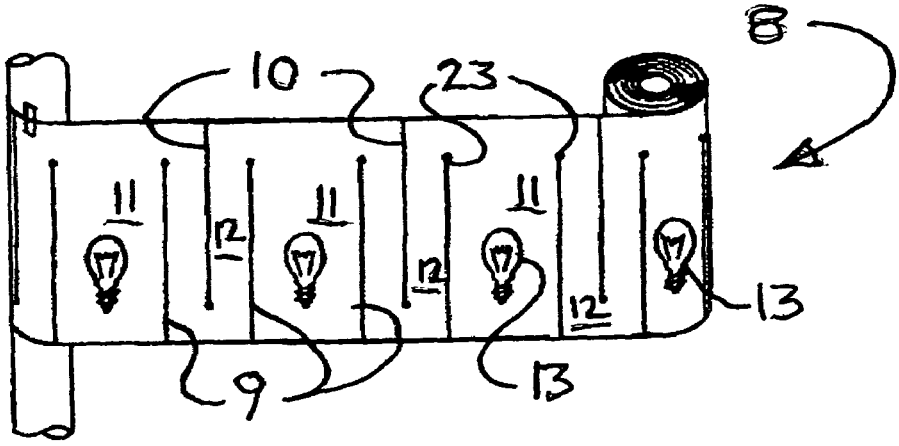
FIG. 3 shows a section of tape having transverse cuts that produce widely spaced hanging rectangular pennants when the tape is deployed.

FIGS. 3 through 6 show how cuts can be made to produce rectangular pennants. FIG. 3 shows a section of tape 8 having a repeated series of transverse linear cuts. The lines extend from one edge of the tape to a point close to the second edge of the tape. The repeated sequence of cuts is two lines 9 from one edge of the tape followed by one line 10 from the other edge. The spacing between the two lines 9 extending from the same edge is relatively wide, thereby defining width of the pennants 11. The spacing between the two lines, 9 and 10, extending from opposite edges of the tape is relatively narrow, thereby defining the width of the connecting bands 12. For illustrative purposes, a series of right-side-up light bulbs 13 is printed on one surface of the tape in the pennant areas.

Figure 4:
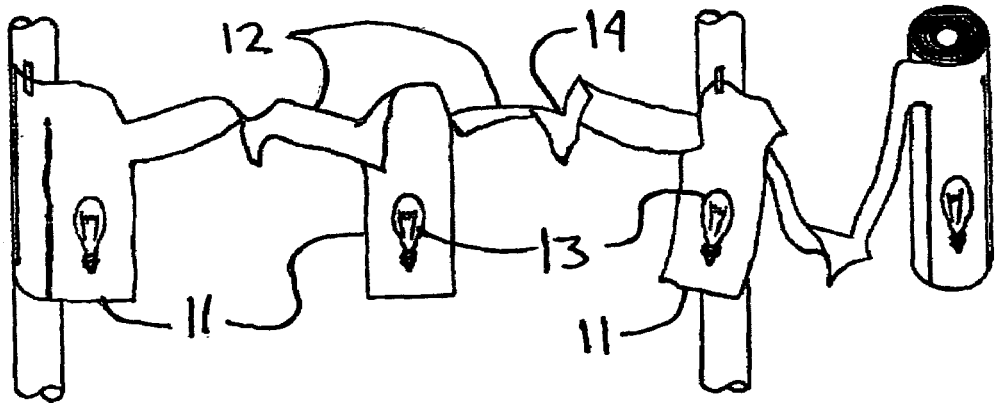
FIG. 4 shows the connected hanging rectangular pennants after deployment of the tape shown in FIG. 3. The pennant surfaces that were initially to the outside of the tape roll in FIG. 3 all face the same direction after deployment.

As shown in FIG. 4, the tape of FIG. 3 deploys to a series of hanging rectangular pennants 11 separated by connecting bands 12. The right-side-up light bulb is visible on the front face of every pennant, since the faces of the pennants that were on the same surface of the tape 8 of FIG. 3 face in the same direction. This is due to the fact that the junction 14 of the connecting band does not twist. The length of each connecting band 12 is almost twice the width of the tape.

Figure 5:
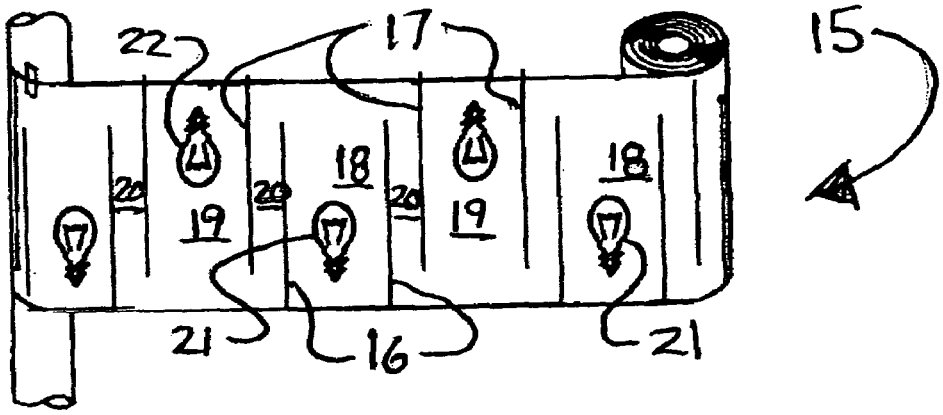
FIG. 5 shows a section of tape having transverse cuts that produce closely spaced hanging rectangular pennants when the tape is deployed.

FIG. 5 shows how tape 15 may be cut differently to produce hanging rectangular pennants upon deployment. In this case, a repeated series of transverse linear cuts are made in the tape. As in FIG. 3, the lines extend from one edge of the tape to a point close to the second edge of the tape. However, in this case, the repeated sequence of cuts is two lines from one edge of the tape 16 and two lines from the other edge of the tape 17. Here, the spacing between the lines alternates from being relatively wide, thereby defining the width of the pennants, 18 and 19, to being relatively narrow, thereby defining the width of the connecting bands 20. For illustrative purposes, right-side-up light bulbs 21 are printed on one surface of alternating pennants 18, and up-side-down light bulbs 22 are printed on the same surface of the alternating pennants 19.

Figure 6:
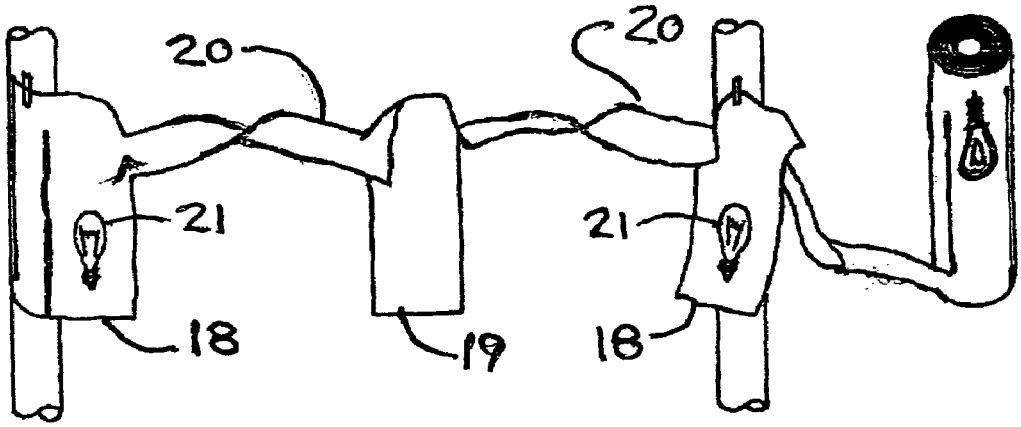
FIG. 6 shows the connected hanging rectangular pennants after deployment of the tape shown in FIG. 5. The pennant surfaces that were initially to the outside of the tape roll in FIG. 5 alternately face in opposite directions after deployment.

As shown in FIG. 6, the tape of FIG. 5 deploys to a series of hanging rectangular pennants 18 and 19 separated by connecting bands 20. The right-side-up light bulb 21 is visible only on the front faces of alternating pennants 18. The faces of alternating pennants 19 appear blank. This due to the fact that the pennant surfaces that were on the same side of tape prior to deployment now alternately face in opposite directions. Therefore if one were to view the opposite side of the deployed tape, one would also see a right-side-up light bulb on the face of every other pennant. This is topologically equivalent to the operation of the triangular pennants of FIGS. 1 and 2. Note that the connecting bands 20 are twisted. The length of a connecting band 20 is approximately equal to the width of the tape. Therefore, the spacing between the hanging pennants is smaller than that of FIG. 4.

Figure 7:
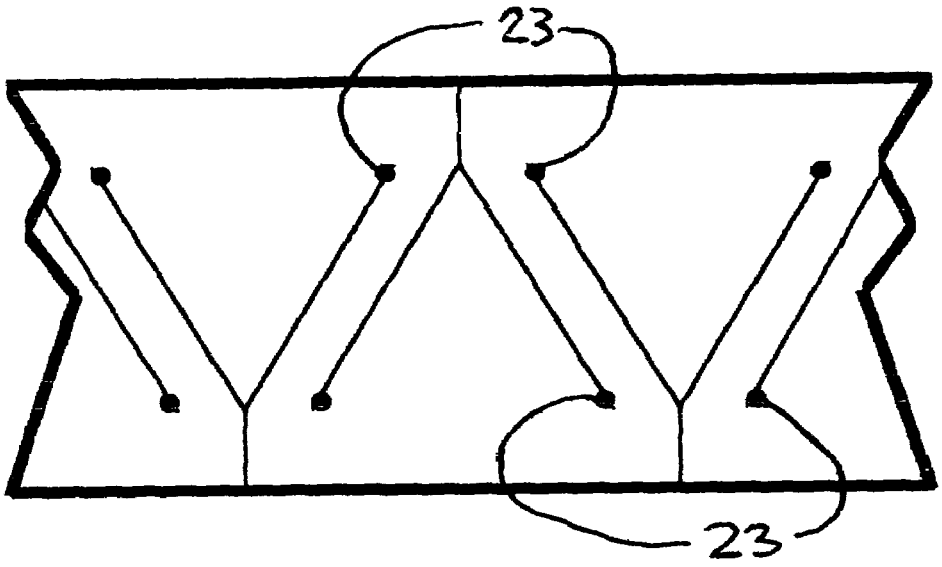
FIG. 7 shows a section of tape having Y-shaped cuts where small holes have been placed to relieve stress.

FIG. 7 shows a section of tape cut with Y-shaped cuts to produce triangular pennants. In the figure, holes 23 are placed where the cuts terminate so as to relieve stress and to prevent inadvertent tearing of that portion of the tape forming the connecting bands. The stress relief holes, 23, are also shown in FIG. 3, and may be applied to any embodiment.

Figure 8:
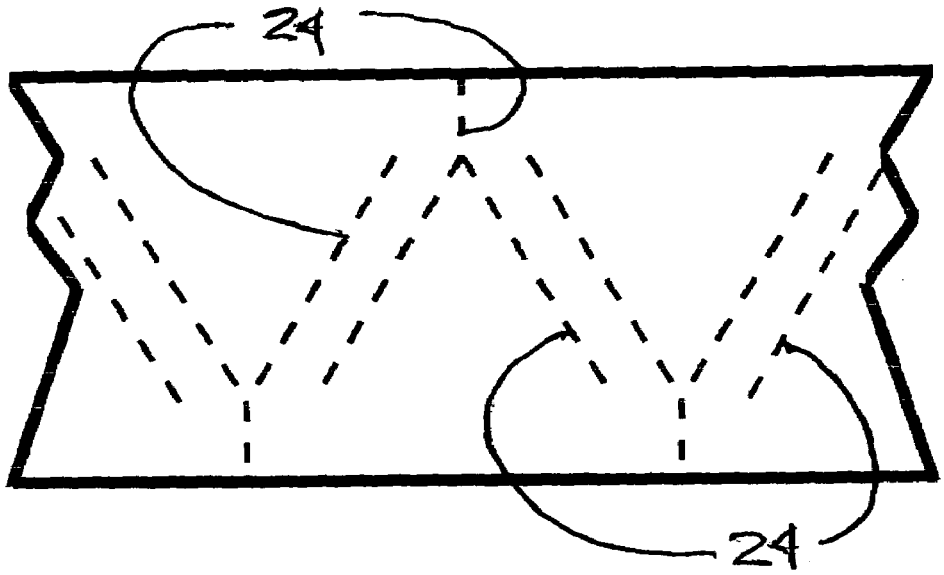
FIG. 8 shows a section of tape having Y-shaped cuts where the cuts are discontinuous or perforated.

FIG. 8 shows a section of tape cut with Y-shaped cuts to produce triangular pennants. In the figure, the cuts 24 are discontinuous or perforated. This is done to prevent inadvertent deployment of the tape due to application of a small longitudinal tensile force. Another way to accomplish the same purpose is to insure that the cuts do not penetrate through the entire thickness of the tape. This can be done using ordinary means.

The pennant tape described herein can be used as a barrier, a warning or a display. The surfaces of the tape may be colored to display pictures or messages. The most likely place to place pictures or messages would be on the pennants since the pennants would represent the larger portion of the deployed device. The pennants may be colored differently from each other (e.g., alternating red, white, and blue). The band areas may be colored differently from the pennant areas (e.g., brown or black), thereby producing a display having a similar appearance to conventional banner displays. Portions of the tape may even be transparent. If the band areas were transparent, the deployed tape would have the appearance of pennants suspended in mid-air.

In addition, pennant shapes other than triangles or rectangles can be created using the same principles. Even shapes such as bells or shamrocks are feasible provided that some waste of tape or web material is tolerable or if one is not particular about the shape of the connecting bands. It is preferable to remove the waste material during the cutting process, particularly by cutting continuous lines completely through the material while leaving the useful parts of the pattern partly cut or discontinuous.

I claim:

1. A tape barrier, display, or warning comprising:

a tape of flexible material having two generally parallel edges and a longitudinal axis, such that the tape has substantially greater length than width, with cuts made into the tape at selected intervals along the tape defining a) a plurality of pennants, each pennant comprising at least one edge, said pennants alternating with b) a plurality of connecting bands, each band comprising two ends and two edges, wherein each band is connected at one end to one adjacent pennant and at the other end to the other adjacent pennant;

wherein at least a portion of one edge of each band is coincident with at least a portion of an edge of an adjacent pennant; and, wherein at least a portion of either edge of the same band is coincident with at least a portion of an edge of the other adjacent pennant;

such that longitudinal tension on the tape will deploy the barrier, display, or warning, thereby causing the edges of the bands to separate from the edges of the adjacent pennants, and substantially increasing the length of the tape, thus forming a series of spaced apart pennants connected by; and such that when deployed, the dimension of the pennants transverse to the longitudinal axis of the tape is substantially greater than the dimension of the bands transverse to the longitudinal axis of the tape.

2. The tape barrier of claim 1 wherein the pattern of cuts is such that at least a portion of one edge of each band is coincident with at least a portion of an edge of an adjacent pennant and at least a portion of the other edge of that same band is coincident with at least a portion of an edge of the other adjacent pennant.

3. The tape barrier of claim 1 wherein the pattern of cuts is such that at least a portion of one edge of each band is coincident with at least a portion of an edge of an adjacent pennant and another portion of the same edge of that band is coincident with at least a portion of an edge of the other adjacent pennant.

4. The tape barrier of claim 1 wherein the pattern of cuts is such that one end of each band is nearer to one edge of the tape, and the other end of the same band is nearer to the other edge of the tape.

5. The tape barrier of claim 1 wherein the pattern of cuts is such that both ends of each band are nearer to one edge of the tape than to the other edge of the tape.

6. The tape barrier of claim 1 wherein the pattern of cuts is a repeated series of Y-shapes, the stem of each successive Y-shape terminating at an opposite edge of the tape.

7. The tape barrier of claim 1 wherein the pattern of cuts is a repeated series of essentially transverse lines, each line extending from an edge of the tape substantially toward the other edge of the tape.

8. The tape barrier of claim 7 wherein the repeated series of lines is two from one edge of the tape and two from the other edge of the tape.

9. The tape barrier of claim 8 wherein the spacing between the lines alternates from being relatively wide to relatively narrow.

10. The tape barrier of claim 7 wherein the repeated series of lines is two from one edge of the tape and then one from the other edge of the tape.

11. The tape barrier of claim 10 wherein the spacing between said two lines is relatively wide and the spacing between each of said two lines and said one line is relatively narrow.

12. The tape barrier of claim 1 wherein at least some of the cuts terminate with stress relief holes.

13. The tape barrier of claim 1 wherein at least some of the cuts are incomplete.

14. The tape barrier of claim 13 wherein at least some of the incomplete cuts do not pass through the tape.

15. The tape barrier of claim 13 wherein at least some of the incomplete cuts are discontinuous.

16. The tape barrier of claim 8 wherein the intervals between the lines repeat in a series, each series first being narrow, then wide, then narrow, and then wide.

17. The tape barrier of claim 10 wherein the intervals between the lines repeat in a series, each series first being narrow, then narrow, and then wide.

* * * * *